United States Patent [19]

Blue

[11] 4,266,781

[45] May 12, 1981

[54] RESILIENT ROTATABLE TOY

[76] Inventor: Walter L. Blue, 212 Turquoise Cir., Prescott, Ariz. 86301

[21] Appl. No.: 89,147

[22] Filed: Oct. 29, 1979

[51] Int. Cl.[3] ..... A63B 65/00

[52] U.S. Cl. ..... 273/420; 273/428

[58] Field of Search ..... 273/416, 419, 420, 423, 273/428, 417

[56] References Cited

U.S. PATENT DOCUMENTS

| | | | |
|---|---|---|---|
| 2,009,759 | 7/1935 | Brown | 273/417 |
| 2,360,173 | 10/1944 | Tanger | 273/417 |
| 2,377,498 | 6/1945 | Jacke | 273/428 |
| 3,069,804 | 12/1962 | Cirafesi | 273/428 X |
| 3,251,353 | 5/1966 | Battaglia | 273/420 X |
| 3,393,911 | 7/1968 | Lawson | 273/428 |
| 3,507,494 | 4/1970 | Finkel | 273/417 X |
| 3,746,334 | 7/1973 | Stubblefield | 273/416 X |
| 4,021,041 | 5/1977 | Goldfarb et al. | 273/420 |
| 4,088,319 | 5/1978 | Clarke | 273/423 X |
| 4,111,422 | 9/1978 | Burcenski | 273/420 X |

FOREIGN PATENT DOCUMENTS

| | | | |
|---|---|---|---|
| 2507950 | 9/1976 | Fed. Rep. of Germany | 273/420 |
| 523614 | 4/1921 | France | 273/420 |
| 24987 | of 1897 | United Kingdom | 273/420 |
| 17363 | of 1915 | United Kingdom | 273/420 |

*Primary Examiner*—Paul E. Shapiro

*Attorney, Agent, or Firm*—Drummond and Nelson

[57] ABSTRACT

A toy adapted to be thrown toward and rotatably rebounded off of a surface and retrieved in mid-air for developing hand-eye coordination and manual dexterity. The toy comprises a resilient ball, an elongate shaft attached to the upper portion of the ball for grasping and throwing the toy, and a tuft of fabric strands attached to the distal end of the shaft for flight stabilizing the toy. The lower portion of the ball is generally hemispherically shaped.

1 Claim, 7 Drawing Figures

RESILIENT ROTATABLE TOY

This invention relates to toys.

More particularly, the invention concerns a toy which is thrown against and rotatably rebounded off a surface.

In another aspect the invention relates to a toy which may be rebounded off of a surface with or without rotation of the toy therefrom.

In a further aspect, the invention pertains to a toy which is rebounded off of a surface and retrieved in midair for development of hand-eye coordination and manual dexterity.

Toys which have generally spherically shaped members and which are projected into and retrieved from the air are known. For example, see U.S. Pat. Nos. 4,088,319 to Clarke and 3,393,911 to Lawson. Typically, these devices are provided with spherically or elliptically shaped bodies having an attached tail. The tail members are laterally deflectable and may be compressed or stretched along the longitudinal axis thereof. Each of these devices is designed to be thrown into the air and caught and is not adapted to be repetitively bounced off of a surface.

The use of such "missile" toys has several limitations. First, a relatively large sized area is required in order to utilize the toys. The toys are not meant to be thrown indoors or within close quarters. Second, the tail members of such toys are, because they stabilize the toy in flight and prevent the rotation thereof, necessarily of considerable length in relation to the body of the toy. The lengthy tails make the flight of the toy visually disinteresting and, because the tails prevent rotation of the toy, simplify the process of catching the toy. Finally, since throwing and retrieving these prior art devices is not especially difficult the user develops the necessary proficiency in a relatively short length of time and has a tendency to loose interest in using the toy.

The spherical toy ball constructed of rubber or some other elastic material has been long known. The simple structure of a rubber ball functions to limit the number of different manuevers or "tricks" which may be performed with the ball. The user is obviously generally limited to bouncing, throwing and catching the ball. As was the case with the "missile" toys, mastery of use of a rubber ball is not difficult and a user tends to have a short-term interest in utilizing the ball. The limited range of manipulations provided by a simple resilient ball probably explains in part why such a wide variety of other sports like golf, pool and basketball have evolved which employ implements in addition to a ball.

Accordingly, it would be desirable to provide a rotatable toy which could be rebounded off of a surface and which would provide a range of possible manipulations having varying degrees of difficulty to sustain the interest of the user.

It would further be desirable to provide such a toy which could be utilized in a relatively small area and which was of simple and durable construction.

Therefore, a principal object of the present invention is to provide a toy which may be rotatably rebounded off of a surface and retrieved from mid-air.

Another object of the instant invention is the provision of a toy which would offer a variety of manipulations having varying degrees of difficulty.

A further object of the invention is to provide a toy which would require substantial development of hand-eye coordination and manual dexterity in order to completely master manipulation of the toy.

Still another object of the instant invention is to provide a toy which is of durable and simple construction and is of a size which allows the user to conveniently carry the toy in his pocket.

These and other, further and more specific objects and advantages of the invention will be apparent to those skilled in the art from the following detailed description thereof, taken in conjunction with the drawings, in which.

Briefly, in accordance with my invention, I provide a rotatable toy adapted to be thrown toward and rebounded off of a surface and retrieved in mid-air for developing hand-eye coordination and manual dexterity.

The toy comprises a substantially resilient member, elongate rod means attached to the upper portion of the resilient member for grasping and throwing the toy, and means attached to the end of the rod means for flight stabilizing the toy. The lower portion of the resilient member is generally hemi-spherically shaped.

Figure 1:
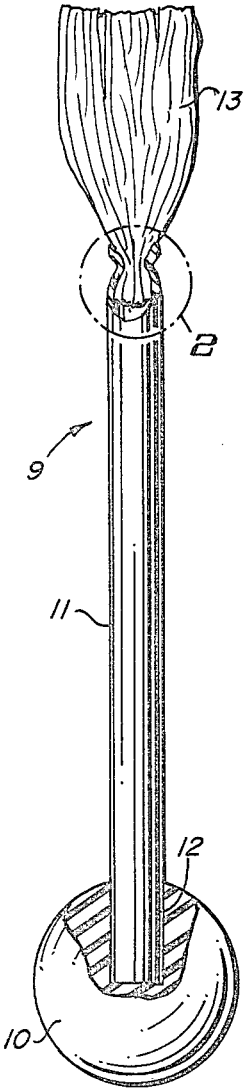
FIG. 1 is a side view of the presently preferred embodiment of my invention having the outer portion thereof broken away to further illustrate the interior construction thereof.
Figure 2:
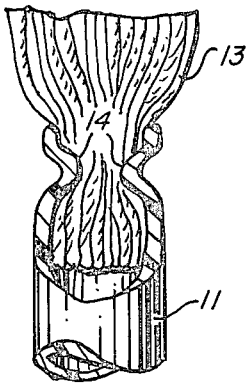
FIG. 2 is an enlarged partial side view of the toy of FIG. 1 taken at the point indicated by the dashed circle 2 of FIG. 1.

Turning now to the drawings, which depict the presently preferred embodiments of the invention for the purpose of illustrating the practice thereof and not by the way of limitation of the scope of the invention, FIGS. 1 and 2 illustrate the presently preferred embodiment of the invention generally indicated by reference character 9 and consisting of a generally spherical resilient body member 10, stem 11 and tassel member 13. Aperture 12 of spherical member 10 receives the lower end of stem 11.

As illustrated in FIG. 2, the upper end of stem 11 is, after tassel member 13 is inserted therein, crimped to form indents 14 which secure tassel 13.

Figure 3:
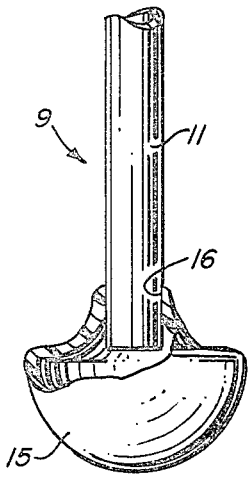
FIG. 3 is a partial side view of an alternate embodiment of a toy device constructed in accordance with my invention.

In another embodiment of the invention, shown in FIG. 3, stem 11 is received by aperture 16 in hemispherically shaped member 15. As one skilled in the art would readily recognize, the hemi-spherical shape is acceptable because stem 11 permits only the lower half of flexible member 10 to contact and rebound from the ground when the toy strikes a surface. A completely spherical resilient member is not required in order for the toy to properly function.

Figure 5:
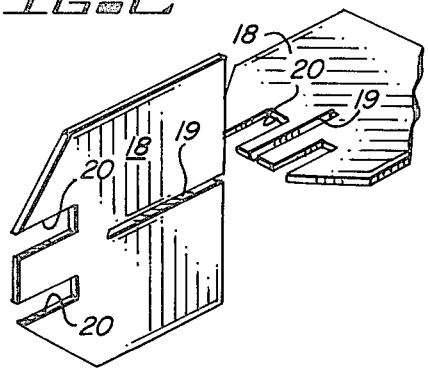
FIG. 5 is a perspective view illustrating the assembly of the toy device of FIG. 4.
Figure 4:
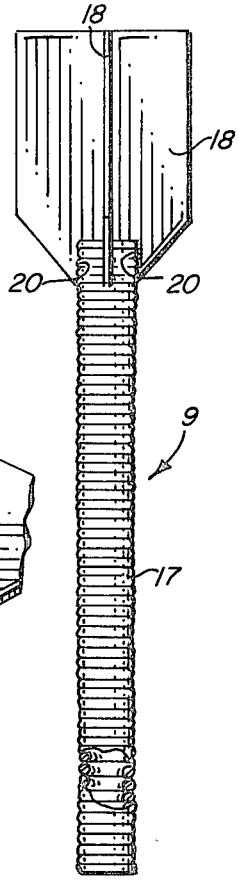
FIG. 4 is a partial side view of another embodiment of the invention.

In a further embodiment of the invention, as shown in FIGS. 4 and 5, the stem is comprised of a substantially rigid spring 17. Spring 17 is provided with generally rectangular panel members 18. In assembly, panel members 18 are slid together along interlocking slots 19.

Generally U-shaped apertures 20 in panels 18 receive and frictionally engage the wall of spring 17.

Figure 6:
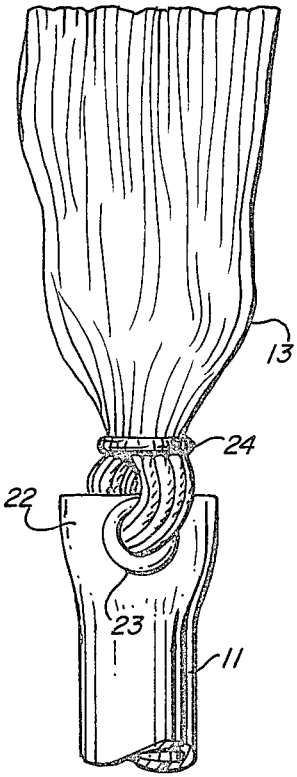
FIG. 6 is a side view of yet another embodiment of the invention.

FIG. 6 illustrates yet another embodiment of the invention wherein the upper end of stem 11 is provided with ear 22 having eyelet 23 implaced therein. Strands of tassel 13 are threaded through eyelet 23 and secured in position by elastic band 24.

Yet another method of attaching the tassel comprises using heat and pressure to flatten the distal end of stem 11. A hole is punched in the flattened portion and the tassel threaded therethrough and secured by a rubber band.

Figure 7:
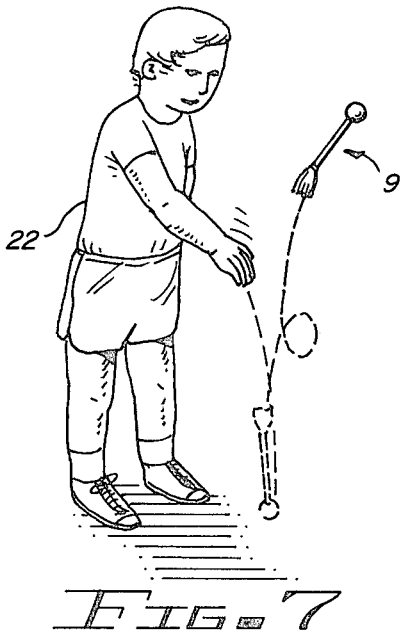
FIG. 7 is an elevational perspective view illustrating the utilization of the toy of FIG. 1.

In use the toy is grasped about the stem, rebounded off of a surface as shown in FIG. 7 and retrieved in mid-air. By imparting appropriate "english" to the toy, the toy may be thrown so that it rebounds rotating in a clockwise or counterclockwise direction; or, the invention may be released so that on rebounding the circle described by the path of travel of the rotating stem lies in a plane perpendicular to or parallel to the front of the body of the user.

Further, the invention may be, with substantially more difficulty than is required to alter the direction of rotation of the toy device, rebounded off of a surface without rotation. The user may further challenge his manual coordination and dexterity by rebounding two or more toy devices at once.

The toy device may also be bounced by striking the resilient member of the toy with the hand. When the toy device is rotating after rebounding from a surface, it will momentarily assume a position wherein the stem is parallel to the ground. At this instant a user may strike the resilient member with his hand and bounce the toy in a manner similar to that used by a basketball player. This manuever requires considerable hand-eye coordination.

It will be appreciated by those skilled in the art that various materials and methods consistent with the manufacture of toys are available for fabrication of the toy.

The presently preferred embodiment of the invention is constructed utilizing a "Superball" manufactured by Wham-O Manufacturing Company. The ball has a diameter of approximately one and seven-eights inches. A three-eights diameter aperture is drilled in the ball 10 and a length of hollow plastic tubing 11 from a peashooter is friction fit into the aperture. The tassel 13 is formed of yarn having strands which resist raveling. To secure the tassel in the hollow plastic tubing, the plastic is heated, the ends of the tassel inserted in the tubing and the plastic crimped with a pair of pliers. Tassel 13 is more effective in slowing the rotation of the ball than the arrow-type tail illustrated in FIGS. 4 and 5 because panels 18 comprising the arrow-type tail are aerodynamically "cleaner" and produce less air resistance in relation to their size.

The presently preferred construction described above has several advantages. First, adhesive is not required when the plastic tubing is inserted in aperture 12 of ball 10 because constant rebounding of the ball forces the stem into aperture 12. If the stem does work free of the aperture, the toy is easily repaired by manually forcing the stem back into the aperture. In addition, if the stem is damaged, inserting a replacement stem is a simple matter.

Second, the high compression "Superball" permits the toy to be easily rebounded to substantial heights so that it may be caught in a shirt pocket or bounced above the user's head and caught behind the back.

A further advantage of the toy is that it may be merchandised in a kit form so the user may assemble the toy. As was ealier described, the toy device may be quickly assembled by relatively unskilled persons using only simple, conventional hand tools. In this regard, the embodiment of the device shown in FIG. 6 wherein tassel 13 is secured without the use of heat or pliers is particularly appropriate for a kit form of the toy.

If the stem 11 provided with the toy device is too short, the toy rotates too rapidly in flight and stem 11 may strike the surface ahead of resilient member 10 when an attempt is made to rebound the toy off of the ground. Likewise, if the stem is too lengthy, the toy rotates too slowly, is awkward to manipulate and carry, and, as is the case with a tail that is too short, the stem may strike the ground ahead of resilient member 10.

In the presently preferred construction of the device I have found that the ideal ratio of stem length to diameter of the resilient member is approximately 2.25:1, although ratios in the range of 1.5:1 and 3:1 function acceptably.

Stem 11 must have sufficient rigidity to generally maintain its linear elongate form during rotation of the toy device in flight so that movement of the toy both in flight and in rebounding from a surface is controllable and consistent. Although stem 11 may be comprised of a resilient material it is preferable, in order to facilitate throwing the toy, that such material offer substantial resistance to compression or extension of the stem along the longitudinal axis thereof. Similarly, the stem may be constructed of a resilient material which permits the stem to be laterally deflected as long as the linear shape of the stem is generally maintained in flight.

Having described my invention in such terms as to enable those skilled in the art to understand and practice it, and having identified the presently preferred embodiments thereof, I claim:

1. A toy adapted for use within a confined area, and to be thrown toward and rotatably rebounded from a surface and retrieved in mid-air for the development of hand-eye coordination and manual dexterity, said toy being readily disassembled and assembled free of adhesives and other permanent affixing means, and comprising, (a) a tuft of fabric strands, (b) a substantially rigid elongate shaft having a first end and a distal end, said distal end having an aperture for receiving said fabric strands, (c) a resilient generally spherical ball having a bore adapted to frictionally receive said first end of said shaft, the ratio of the diameter of said ball to the length of said shaft being between 1:1.5 and 1:3, and, (d) means for detachably, fixedly securing said fabric strands in place on said shaft after a portion of each strand is passed through said structure, said fabric strands slowing and stabalizing the rotation of said toy and being readily removed from said shaft for repair and replacement.

* * * * *